US009212028B2

(12) United States Patent
Novak

(10) Patent No.: US 9,212,028 B2
(45) Date of Patent: Dec. 15, 2015

(54) OBSTRUCTION SENSOR SYSTEM AND METHOD FOR ELEVATOR ENTRY AND EXIT

(75) Inventor: Yuri Novak, Staten Island, NY (US)

(73) Assignee: Precision Elevator Corp., Brooklyn, NY (US)

( * ) Notice: Subject to any disclaimer, the term of this patent is extended or adjusted under 35 U.S.C. 154(b) by 646 days.

(21) Appl. No.: 13/563,334

(22) Filed: Jul. 31, 2012

(65) Prior Publication Data

US 2014/0034426 A1 Feb. 6, 2014

(51) Int. Cl.
*B66B 13/14* (2006.01)
*B66B 13/26* (2006.01)

(52) U.S. Cl.
CPC ..... *B66B 13/26* (2013.01)

(58) Field of Classification Search
CPC ..... B66B 13/26
USPC ..... 187/313, 316, 317, 391, 392, 393; 49/26, 28; 318/466–470
See application file for complete search history.

(56) References Cited

U.S. PATENT DOCUMENTS

| | | | | | |
|---|---|---|---|---|---|
| 31,128 | A | | 1/1861 | Otis | |
| 4,029,176 | A | | 6/1977 | Mills | |
| 4,577,437 | A | * | 3/1986 | Gionet et al. | 49/25 |
| 4,621,452 | A | | 11/1986 | Deeg | |
| 4,732,238 | A | | 3/1988 | Baumgartner | |
| 4,753,323 | A | | 6/1988 | Kahkipuro | |
| 4,976,337 | A | * | 12/1990 | Trett | 49/31 |
| 5,284,225 | A | * | 2/1994 | Platt | 187/316 |
| 5,394,961 | A | | 3/1995 | Biver | |
| 5,518,086 | A | | 5/1996 | Tyni | |
| 5,698,824 | A | * | 12/1997 | Platt | 187/317 |
| 6,051,829 | A | * | 4/2000 | Full | 250/221 |
| 6,386,326 | B2 | * | 5/2002 | Pustelniak et al. | 187/317 |
| 6,962,239 | B2 | | 11/2005 | Shikai et al. | |
| 6,973,998 | B2 | | 12/2005 | Deplazes et al. | |
| 7,093,692 | B2 | | 8/2006 | Koura | |
| 7,140,469 | B2 | * | 11/2006 | Deplazes et al. | 187/316 |
| 7,165,655 | B2 | * | 1/2007 | Cook et al. | 187/316 |
| 7,992,687 | B2 | * | 8/2011 | Yumura et al. | 187/316 |
| 8,510,990 | B2 | * | 8/2013 | Agam et al. | 49/28 |
| 8,904,708 | B2 | * | 12/2014 | Zacchio et al. | 49/25 |

OTHER PUBLICATIONS

Preliminary Report on Patentability issued in connection with PCT/US2013/053022.

* cited by examiner

*Primary Examiner* — Anthony Salata
(74) *Attorney, Agent, or Firm* — Cooper & Dunham, LLP

(57) ABSTRACT

An elevator car system and method for operating elevators doors includes an elevator car having a door capable of opening and closing along a pathway and an interior portion internal to the door, a first obstruction sensor disposed on the door capable of detecting an obstruction in the pathway of the door, and a supplemental obstruction sensor disposed in the interior portion of the elevator car system capable of detecting an obstruction in an area adjacent to the door, wherein the door opens or closes based on the detection of the first obstruction sensor or the detection of the second obstruction sensor. The interior portion of the elevator car may include a recessed channel, with the supplemental obstruction sensor being disposed in the recessed channel.

16 Claims, 4 Drawing Sheets

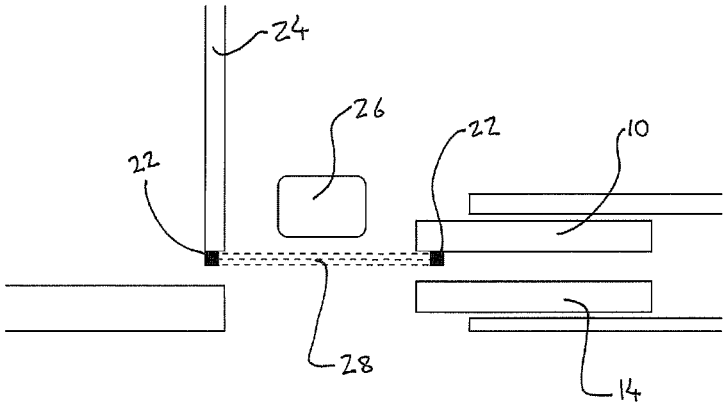
Figure 2 *(Prior Art)*
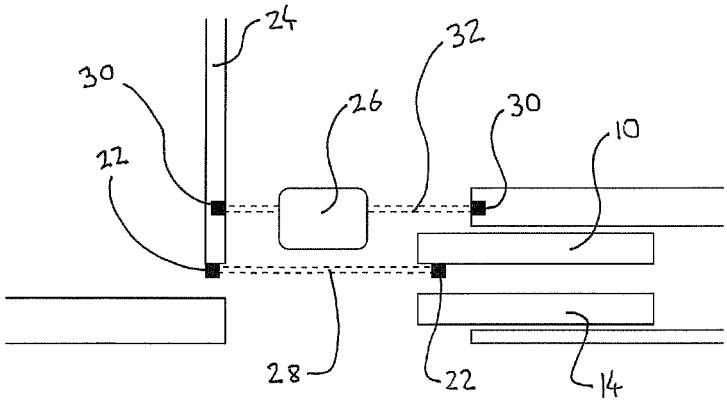
Figure 3

OBSTRUCTION SENSOR SYSTEM AND METHOD FOR ELEVATOR ENTRY AND EXIT

TECHNICAL FIELD

This invention relates to sensors for detecting the presence of a person or other obstruction near elevator doors and doorways.

DESCRIPTION OF RELATED ART

For many decades, elevators have served as essential fixtures in commercial, residential and industrial buildings, ferrying people and materials between floors and making possible the vertical expansion of cities. Since the introduction of elevators, safety has been a primary concern in the design and installation of elevators. Elevator safety includes Elisha Otis' safety brake intended to keep an elevator car from plummeting in the event of a broken hoist rope, and later focused on elevator doors.

Elevator doors have been a particular concern in elevator safety, owing to the increased potential for personal injury and property damage in the event of their improper operation or failure. In particular, much effort has been focused on controlling the automatic closure of elevator doors while a person or obstruction is in the path of the doors' movement. For example, many different types of sensors have been developed to detect the presence of a person or object in the path of a closing door or in proximity thereto.

In addition to mechanical sensors, which sense when a door strikes an object, electrical sensors of many types have been developed to sense the presence of an obstruction before the door has a chance to contact the obstruction. For example, sensors have been proposed that detect the obstruction or reflection of visible or non-visible light in the pathway of an elevator door (see, for example, U.S. Pat. Nos. 4,621,452, 5,394,961 and 6,973,998, all of which are incorporated by reference herein in their entireties), the reflection of acoustic energy from obstructions in the pathway of an elevator door (see, for example, U.S. Pat. No. 4,029,176, which is incorporated by reference herein in its entirety) the response from antennas placed opposite an open elevator car doorway to changed capacitance therebetween in the presence of an obstruction (see, for example, U.S. Pat. Nos. 4,732,238 and 4,753,323, both of which are incorporated by reference herein in their entireties) and the presence of people or obstructions in a lobby area outside an elevator door (see, for example, U.S. Pat. No. 5,518,086, which is incorporated by reference herein in its entirety).

However, the implementation of such sensors is often limited to the immediate pathway of an elevator car door or an elevator shaftway door. Such limitation, while economical, has left a need for a more considered approach to elevator door safety.

SUMMARY

This invention relates to elevator door systems, elevator obstruction sensors, and methods of operation for elevator doors.

In general, in one aspect, the invention features an elevator car system, including an elevator car having a door capable of opening and closing along a pathway and an interior portion internal to the door, a first obstruction sensor disposed on the door capable of detecting an obstruction in the pathway of the door, and a supplemental obstruction sensor disposed in the interior portion of the elevator car system capable of detecting an obstruction in an area adjacent to the door, wherein the door opens or closes based on the detection of the first obstruction sensor or the detection of the second obstruction sensor.

Implementations of the invention may include one or more of the following features. The door may be an elevator car door or an elevator shaft door. The interior portion of the elevator car may include a recessed channel, the supplemental obstruction sensor being disposed in the recessed channel. The recessed channel may be elongated and have a "C"-shaped profile. The interior portion of the elevator car may have a surface and a channel recessed relative to the surface, the supplemental obstruction sensor being disposed in the channel.

In general, in another aspect, the invention features an elevator door obstruction sensor apparatus, including a channel disposed within an elevator car having an interior portion internal to a door capable of opening and closing, and an obstruction sensor disposed in the channel capable of detecting an obstruction in an area adjacent to the door, wherein the door opens or closes based on the detection of the obstruction sensor.

Implementations of the invention may include one or more of the following features. The interior portion of the elevator car may have a surface and the channel may include a trough recessed relative to the surface. The channel may be elongated and have a "C"-shaped profile.

In general, in another aspect, the invention features a method of operation for an elevator door, including receiving an instruction to close the door, determining if a first obstruction sensor senses an obstruction, determining if a supplemental obstruction sensor senses an obstruction, and closing the door if neither the first obstruction sensor nor the supplemental obstruction sensor senses an obstruction.

Implementations of the invention may include one or more of the following features. The method may include repeating the steps if either the first obstruction sensor or the supplemental obstruction sensor senses an obstruction. The supplemental obstruction sensor may be disposed within an elevator car in an interior portion internal to the door and in a channel in an area adjacent to the door.

BRIEF DESCRIPTION OF THE DRAWINGS

The above mentioned and other aspects, features and advantages can be more readily understood from the following detailed description with reference to the accompanying drawings, wherein:

FIG. 2 is a partial top view of a prior art elevator door and sensor configuration;

FIG. 3 is a partial top view of an elevator door and sensor configuration according to an exemplary embodiment of the present invention;

DETAILED DESCRIPTION

Supplemental elevator door sensors, elevator door systems, and methods of operation for elevator doors are described herein, with reference to examples and exemplary embodiments. Specific terminology is employed in describing examples and exemplary embodiments. However, the disclosure of this patent specification is not intended to be limited to the specific terminology so selected and it is to be understood that each specific element includes all technical equivalents that operate in a similar manner.

Figure 1A:
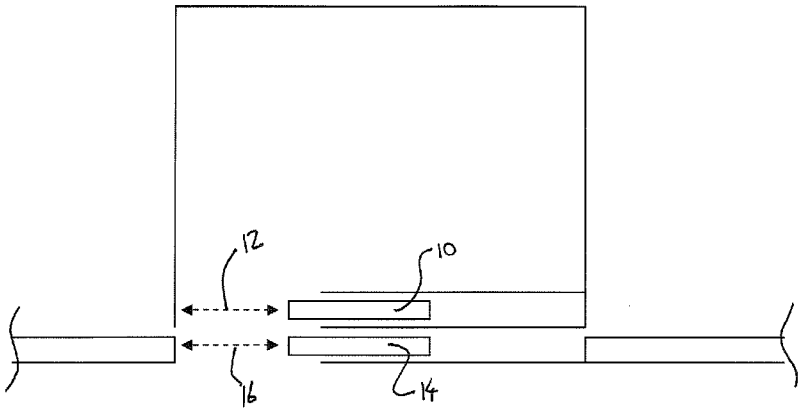
Figure 1A (Prior Art)
FIGS. 1A and 1B are partial top views of prior art elevator configurations.
Figure 1B:
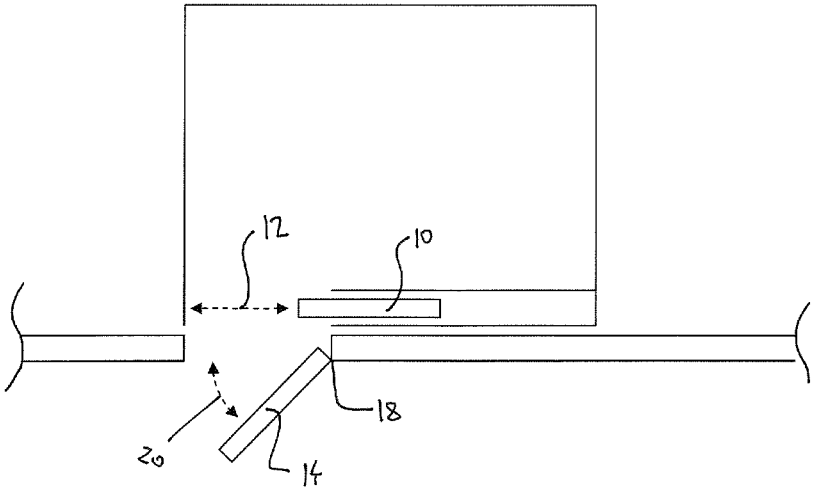
Figure 1B (Prior Art)

Elevator doors typically include at least a pair of doors, namely an elevator car door and an elevator shaftway door (referred to herein as a car door and a shaftway door, respectively, and as elevator doors collectively). FIGS. 1A and 1B show typical elevator door configurations. Car doors 10 are typically configured to slide back and forth along a straight track or path 12. Shaftway doors 14 may be configured to slide along with the car doors 10 in a parallel track or path 16 or may be configured to swing open at a hinge point 18 in an arcuate path 20. Elevator doors may be manual or may be motorized. In one configuration, car doors are driven by an electric motor through a mechanical linkage and shaftway doors are mechanically engaged with the car doors so that they open and close together.

Elevator doors are typically provided with obstruction sensors, as discussed above. Obstruction sensor technology and sensor designs for elevator doors are well known in the art and may take many forms, some of which are discussed above. In the present application, the term obstruction sensor is used generally to refer to any compatible obstruction sensor and is not intended to limit the discussion to any particular sensor type or sensing technology, unless explicitly stated otherwise. Previously, a single obstruction sensor (sometimes comprising several components) was configured at an elevator door opening to detect an obstruction in the immediate path of the elevator doors. For example, as shown in FIG. 2, an obstruction sensor 22 may include components placed on the outside of a car door 10 and opposite the door opening, on the side of elevator car 24. When an obstruction is present between obstruction sensor 22 components, the elevator doors may be programmed to operate in a different manner, e.g. remain open or close at a slower speed.

However, in such previous configurations, there remained a danger that an obstruction may still be in the way of the closing car or shaftway doors, even if such obstruction is not detected by obstruction sensor 22. For example, obstruction 26 is not within the sensing zone 28 of obstruction sensor 22 components, even though it would be struck by car door 10 if the car door were to begin closing.

In an exemplary embodiment, shown in FIG. 3, an elevator door system with a sliding shaftway door 14 is shown with a first obstruction sensor 22 and a supplemental obstruction sensor 30 provided in an area adjacent to and inside car door 10, i.e., internal to the elevator car with respect to car door 10, in an interior portion of the elevator car. As shown, obstruction 26 is detected by supplemental obstruction sensor 30, as it extends into the sensing zone 32 of supplemental obstruction sensor 30.

Figure 4:
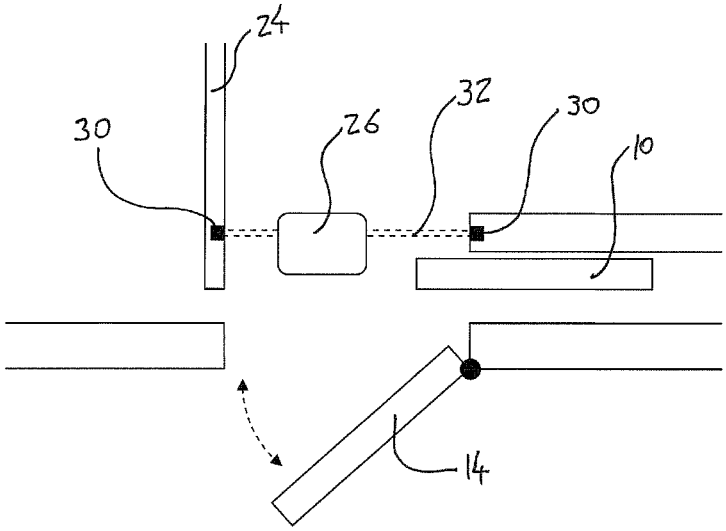
FIG. 4 is a partial top view of an elevator door and sensor configuration according to another exemplary embodiment of the present invention.

In another exemplary embodiment with a swinging shaftway door 14, shown in FIG. 4, a supplemental obstruction sensor 30 may be provided in an area adjacent to and inside car door 10, i.e., internal to the elevator car with respect to car door 10, in an interior portion of the elevator car. As shown, obstruction 26 is detected by supplemental obstruction sensor 30, as it extends into the sensing zone 32 of supplemental obstruction sensor 30.

While the examples of obstruction sensors are shown at right and left sides of an elevator door opening, one skilled in the art will recognize that one or more obstruction sensors may be placed at the top and/or bottom of the door opening instead of or in addition to placement at the sides of the door opening. Likewise, one skilled in the art will recognize that obstruction sensors may comprise a single component or more than one component.

Figure 5:
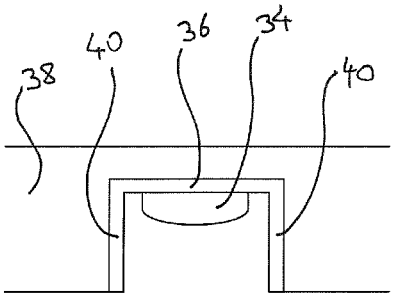
FIG. 5 is a top profile view of an installed elevator obstruction sensor apparatus according to still another exemplary embodiment of the present invention.
Figure 6:
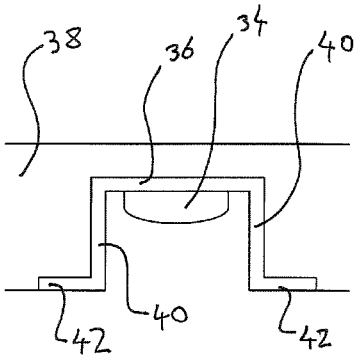
FIG. 6 is a top profile view of an installed elevator obstruction sensor apparatus according to yet another exemplary embodiment of the present invention.

In one exemplary embodiment, shown in FIG. 5, an obstruction sensor component may include an elongated channel and a sensing element 34 provided in the trough 36 of the channel. The channel may be installed in the wall 38 of an elevator car, a door, or a building such that the elongated channel and sensing element 34 are recessed from the surface of an adjacent structure. In such an example, the sensing element 34 may be protected from damage caused by objects striking the structure adjacent the channel. The channel may be provided with a "C"-shaped profile with a trough bottom 34 and legs 40, as shown in FIG. 5, or may be provided with flanges 42 extending from the legs 40, as shown in FIG. 6.

In one example, an obstruction sensor may include two sensor components arranged opposite from one another across an elevator doorway. One obstruction sensor component may comprise a sensing element 34 provided with one or more infrared (IR) light emitters and the opposite sensor component may comprise a sensing element 34 provided with one or more complimentary IR light receivers. Alternatively, one of the sensing elements 34 may include one or more IR light emitters and complimentary IR light receivers, and the opposite sensor element 34 may comprise an IR light reflective surface. Such an obstruction sensor may be configured to detect the presence of an obstruction when the IR light emitted by the IR emitter is not received by the IR receiver, the IR light being blocked by a detected obstruction.

Figure 7:
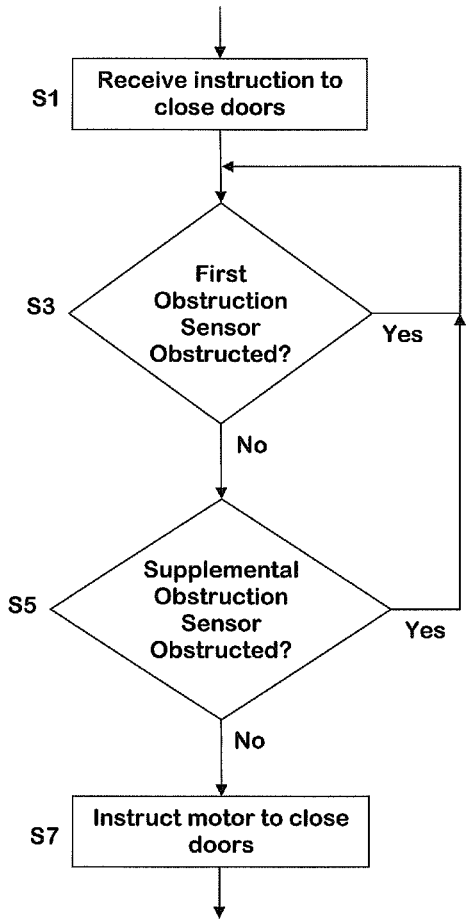
FIG. 7 is a diagram of a method of operation for elevator doors according to an exemplary embodiment of the present invention.

The provision of one or more supplemental obstruction sensors in addition to a first obstruction sensor allows for new methods of operation for elevator doors. For example, in one exemplary embodiment, shown in FIG. 7, a method of operation for elevator doors includes receiving an instruction to close doors S1, determining if a first obstruction sensor senses an obstruction S3, determining if a supplemental obstruction sensor senses an obstruction S5, and instructing a door motor to close the doors S7 if neither the first obstruction sensor nor the supplemental obstruction sensor senses an obstruction. If either the first obstruction sensor or the supplemental obstruction sensor senses an obstruction, the method loops until neither the first obstruction sensor nor the supplemental obstruction sensor senses an obstruction before instructing the door motor to close the doors. In this example, the supplemental obstruction sensor may be placed closer to the inside of the car relative to the first obstruction sensor or the supplemental obstruction sensor may be placed further from the inside of the car relative to the first obstruction sensor.

In any of the above method examples, an instruction to close the doors may, for example, be the result of a button push by an operator of the elevator or may result from a predetermined amount of time having elapsed since the doors were opened.

In addition, the embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted for each other within the scope of this disclosure.

What is claimed is:

1. An elevator car system, comprising:

an elevator car having a door capable of opening and closing along a pathway and an interior portion internal to the door;

a first obstruction sensor disposed on the door capable of detecting an obstruction in the pathway of the door; and a supplemental obstruction sensor disposed adjacent to the door in the interior portion of the elevator car system capable of detecting an obstruction in an area adjacent to the door in the interior portion of the elevator car;

wherein the door opens or closes based on the detection of the first obstruction sensor or the detection of the supplemental obstruction sensor.

2. The elevator car system of claim 1, wherein the door is an elevator car door.

3. The elevator car system of claim 1, wherein the door is an elevator shaft door.

4. The elevator car system of claim 1, wherein the interior portion of the elevator car includes a recessed channel, the supplemental obstruction sensor being disposed in the recessed channel.

5. The elevator car system of claim 4, wherein the recessed channel is elongated and has a "C"-shaped profile.

6. The elevator car system of claim 1, wherein the interior portion of the elevator car has a surface and a channel recessed relative to the surface, the supplemental obstruction sensor being disposed in the channel.

7. An elevator door obstruction sensor apparatus, comprising:

a channel disposed adjacent to a door within an elevator car having an interior portion internal to the door, the door capable of opening and closing; and an obstruction sensor disposed in the channel capable of detecting an Obstruction in an area adjacent to the door in the interior portion; wherein the door opens or closes based on the detection of the obstruction sensor.

8. The elevator door obstruction sensor apparatus of claim 7, wherein the interior portion of the elevator car has a surface and the channel includes a trough recessed relative to the surface.

9. The elevator door obstruction sensor apparatus of claim 7, wherein the channel is elongated and has a "C"-shaped profile.

10. A method of operation for all elevator door, comprising:

(a) receiving an instruction to close the door;

(b) determining if a first obstruction sensor senses an obstruction;

(c) determining if a supplemental obstruction disposed adjacent to the door sensor senses an obstruction in an interior portion of the door; and (d) closing the door if neither the first obstruction sensor nor the supplemental obstruction sensor senses an obstruction.

11. The method of claim 10, further comprising: (c) repeating steps (b)-(d) if either the first obstruction sensor or the supplemental obstruction sensor senses an obstruction.

12. The method of claim 10, wherein the supplemental obstruction sensor is disposed within an elevator car in the interior portion internal to the door and in a channel in an area adjacent to the door.

13. The elevator car system of claim 1, wherein the supplemental obstruction sensor includes a first sensor component and a second sensor component, the first and second sensor components being arranged opposite each other across a doorway of the door of the elevator car.

14. The elevator car system of claim 13, wherein the first sensor component and the second sensor component operate to detect the obstruction when the obstruction is located between the first and second sensor components.

15. The elevator door obstruction sensor apparatus of claim 7, wherein the obstruction sensor includes a first sensor component and a second sensor component, the first and second sensor components being arranged opposite each other across a doorway of the door of the elevator car.

16. The elevator door obstruction sensor apparatus of claim 15, wherein the first sensor component and the second sensor component operate to detect the obstruction when the obstruction is located between the first and second sensor components.

* * * * *